United States Patent [19]

Noble et al.

[11] 4,189,181

[45] Feb. 19, 1980

[54] WATER-FILLED CHAIR

[76] Inventors: David Noble; Donald Noble, both of R.F.D. 6, Box 358, Richmond, Va. 23231

[21] Appl. No.: 899,605

[22] Filed: Apr. 24, 1978

[51] Int. Cl.[2] ..... A47C 5/00

[52] U.S. Cl. ..... 297/455; 297/DIG. 3; 5/432; 5/455

[58] Field of Search ..... 297/230, 231, 452, 455, 297/DIG. 3, 445; 5/370

[56] References Cited

U.S. PATENT DOCUMENTS

| | | | |
|---|---|---|---|
| 2,572,689 | 10/1951 | Bell | 297/DIG. 3 |
| 2,834,397 | 5/1958 | Kluglein et al. | 297/433 X |
| 3,689,949 | 9/1972 | Weinstein et al. | 297/DIG. 3 |
| 3,702,484 | 11/1972 | Tobinick et al. | 5/370 |
| 3,982,786 | 9/1976 | Burgin et al. | 297/DIG. 3 |
| 3,996,633 | 12/1976 | Burke | 5/370 |
| 4,067,078 | 1/1978 | Winston | 297/231 |
| 4,077,074 | 3/1978 | Fogel | 5/370 |
| 4,108,492 | 8/1978 | Kirby | 297/DIG. 3 |

*Primary Examiner*—Francis K. Zugel
*Attorney, Agent, or Firm*—Norman B. Rainer

[57] ABSTRACT

A chair is provided having a seating portion containing a water-filled container formed of a thin flexible film and having a horizontally disposed upper flat surface for the supportive cushioning of the user, and an upright portion having an assembly of 5 to 20 elongated water-filled enclosures disposed in parallel horizontal juxtaposition. The elongated enclosures have a rounded outer contour which provides cushioning to the user's back. The hydrostatic pressure within each elongated water-filled enclosure is between 1" and 4" of water.

7 Claims, 4 Drawing Figures

WATER-FILLED CHAIR

BACKGROUND OF THE INVENTION

This invention relates to an improved chair in which the user may be seated in an upright or reclining position, and is particularly concerned with chairs of such nature containing confined volumes of water which impart supportive and cushioning effects.

Water-filled mattresses are generally well known and are frequently of rectangular shape having a depth of about 12 inches. In such mattresses, a thin-walled flexible plastic enclosure is utilized to confine a body of water. The plastic enclosure is supported from beneath by a flat floor or shelf, and at its sides by retaining walls. In this manner, the hydrostatic force generated by the depth of confined water does not distort or destroy the thin-walled enclosure, and a horizontally disposed upper surface is provided capable of supporting the user's weight.

The upper surface of a water-filled bed supports the user's weight primarily by virtue of the buoyant characteristic of a liquid which, when displaced exerts an upward force in accordance with the Archimedes principle of physics. The buoyancy effect, moderated by the effect of the film, creates a comfortable weight-bearing underlying support for the human body.

More conventional matress construction utilizing springs, flexible foams, fibrous batting, or combinations thereof support the user's weight essentially by their resilient characteristics acting in accordance with Hooke's law of physics. Their supportive properties are considerably different than those of water-filled mattresses and are highly dependent upon the characteristics of construction.

Chairs are generally fabricated employing the conventional supportive principles and components used in matress construction. In some instances, chairs have been made by confining air or a semi-fluid low density granular filling material such as dried beans or plastic foam. However, the use of liquid-filled chairs having supportive characteristics generally analagous to those of water-filled mattresses has not been disclosed heretofore.

Although securement of the comfort of the supportive characteristics of a water-filled mattress in a chair structure is a desirable goal, its actual achievement is made difficult by the inherent property of liquids to flow and to generate a hydrostatic pressure. Since a chair structure necessitates the arrangement of at least some structural member in substantially upright disposition, considerable hydrostatic pressure could be encountered. Such pressures would distort thin flexible films or rupture seams. If very strong, non-distorting films are utilized, the combined effect of the strong film and high retained pressure forms a turgid system having little capacity for deformation necessary for acceptable cushioning effect.

It is accordingly an object of the present invention to provide a chair containing water-filled cushioning members. It is a further object to provide a chair containing volumes of water confined in a manner to apply supportive and cushioning effects to the user's body. It is still another object of this invention to provide a chair containing a confined volume of water in substantially upright disposition and adapted to provide a cushioning effect without engendering high hydrostatic pressure.

These and other objects and advantages of the invention will be apparent from the following description.

SUMMARY OF THE INVENTION

The above and other beneficial objects and advantages are accomplished in general by the provision of an improved chair comprising seating and upright portions containing separate water-filled members. The seating portion contains a volume of water confined in a container fabricated of a flexible thin film and disposed in a manner so as to form an uppor horizontal surface having cushioning characteristics similar to those demonstrated in water-filled mattresses. The container is comprised of substantially identical upper and lower members spaced apart by a substantially vertically disposed sidewall member running the periphery of said upper and lower members and joining therewith to define a water-impervious closed volume container. When properly installed in said seating portion and filled with water, the container is supported from beneath by a platform upraised from the floor and attached to said seating portion. The sidewall member of said container abuts against rigid retaining walls within said seating portion.

The upright portion of the chair, which originates at the rear of the seating portion and extends generally upwardly therefrom, is comprised of a rigid back panel and a series of elongated horizontally disposed water-filled deformable enclosures. Said enclosures are anchored in parallel juxtaposition to that surface of said back panel which faces the seating portion of the chair. The configurations and dimensions of said elongated enclosures are such that the hydrostatic pressure in each, when filled with water, is between about 1" and 4" of water.

Additional water-filled chambers may optionally be employed in arm rest structures associated with said seating portion. The chair may in various embodiments be upholstered entirely or in part with decorative fabric and padding materials well known in the furniture arts.

The upright portion may in some embodiments be made adjustably positionable with respect to the seating portion, and may be contoured so as to provide direct support to the user's head, neck or lower back. Electrical heating and vibrating means may optionally be incorporated into the chair.

BRIEF DESCRIPTION OF THE DRAWING

In the accompanying drawing forming a part of this specification and in which similar numerals of reference indicate corresponding parts in all the figures of the drawing.

DESCRIPTION OF THE PREFERRED EMBODIMENT

Figure 1:
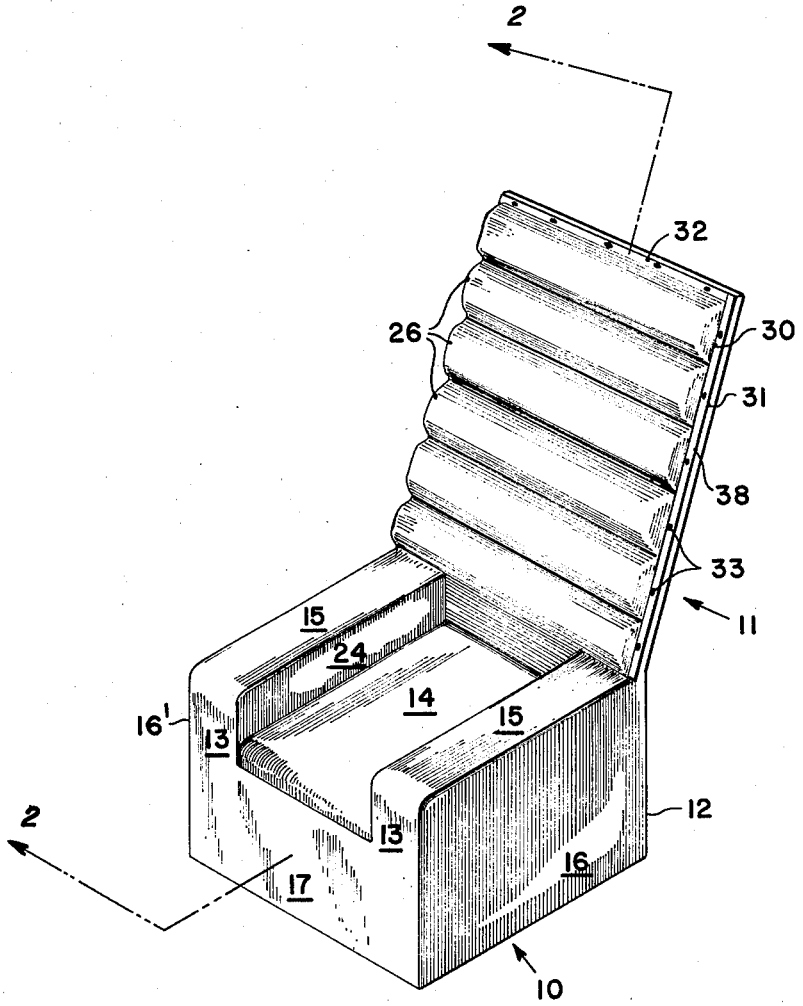
FIG. 1 is a perspective view of an embodiment of the chair of the present invention.
Figure 3:
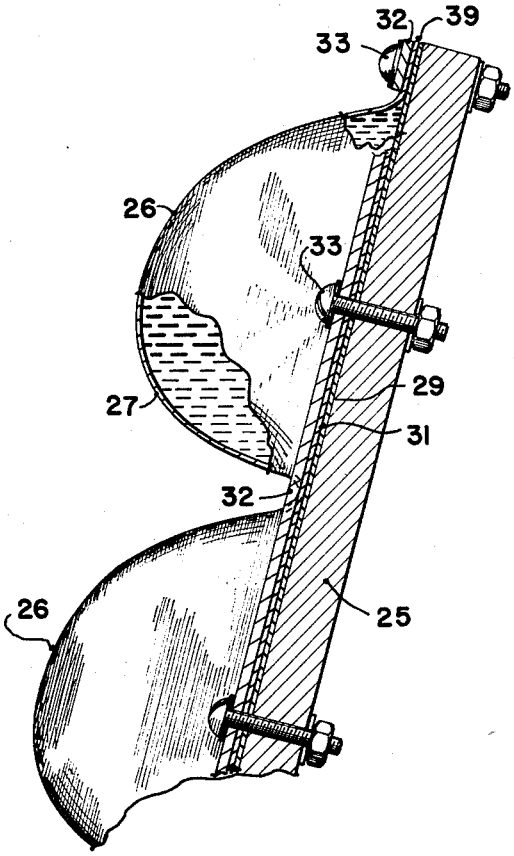
FIG. 3 is an enlarged fragmentary view of the uppermost part of the upright portion of the chair as shown in FIG. 2.

FIG. 1 illustrates a chair of the present invention having a box-like seating portion 10 having an outer structure comprised of identical side panels 16 and 16$^1$, front panel 17, and rear panel 12. Upright portion 11 extends upwardly from its site of joinder at the rear panel 12 of said seating portion. Centered between arm rests 13 of the seating portion is a generally rectangular water-filled container 14, the upper surface of which is horizontally disposed at a level below the uppermost portions 15 of arms rests 13.

Figure 2:
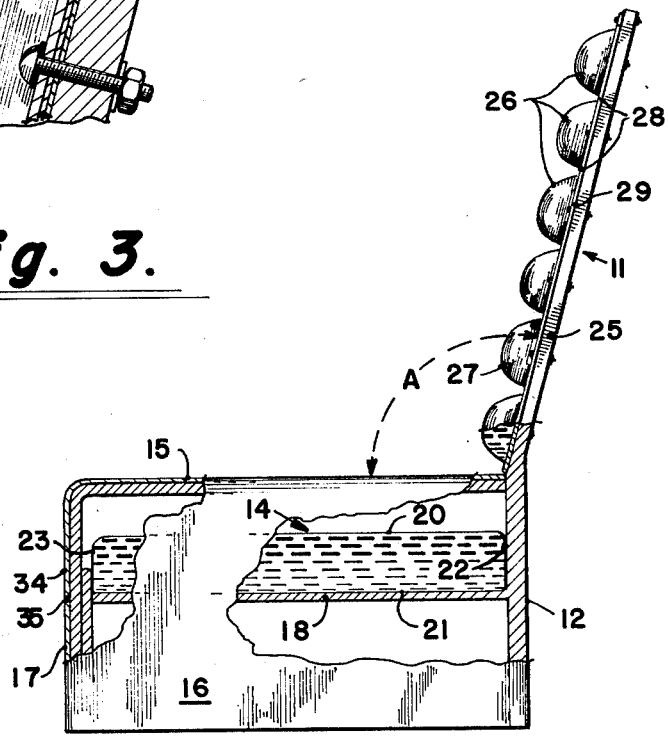
FIG. 2 is a side, partially sectional view taken along the line 2—2 of FIG. 1.

The water-filled container 14, fabricated of flexible film material, has an upper surface 20, as more clearly shown in FIG. 2, a lower surface 21 and vertically disposed sidewall 22 traversing the four sides of the rectangular perimeter of the container. The upper region 23 of the front sidewall member is angled somewhat inwardly toward the center of the container. Lower surface 21 is supported from beneath by platform 18, held in position by attachment to the inner faces of panels 16, 16[1], 17 and 12. The sidewall 22 of container 14 abuts against the inside faces of front panel 17, rear panel 12, and the inside walls 24 of arm rests 13.

The upright portion 11 is shown to have a rigid back panel 25 which originates at the rear of seating portion 10 and extends generally upwardly therefrom. The surface of back panel 25 which faces seating portion 10 contains an assembly of elongated horizontally disposed water-filled enclosures 26. The elongated enclosures of the embodiment of FIGS. 1 and 2 are formed by the bonding of a continuous integral upper sheet of flexible film 27 to a continuous integral flat backing sheet 29. Bonding is achieved along horizontally spaced lines 28 separating sinusoidal loops of upper sheet 27, and along end lines 30. Apron strips 31 are formed along both upright sides of the assembly of enclosures 26. The apron strips consist of the upper sheet 27 and backing sheet 29 in flat contiguous disposition bounded as an elongated zone by end lines 30 and the side edges 38 of sheets 27 and 29. In analagous manner, a horizontal apron strip 39 is formed above the uppermost enclosure. The assembly of enclosures 26 may be attached to back panel 25 by means of adhesives applied to the rear of backing sheet 29. Clamping bars 32 engage with back panel 25 by bolts 33 penetrating intervening apron strips 31 and 39.

The various rigid members of the chair may be fabricated of wood, plastic, or equivalent materials, and joined by conventional fastening means such as glueing, bolting, dovetailing or the like. Fabric 34 and padding 35 are shown covering the panels and arm rests of the embodiment of FIG. 2. Suitable fabric and padding materials may, in other embodiments, be applied also to other chair surfaces, including the upper surfaces of water-filled container 14 and elongated enclosures 26.

The film material utilized for the construction of the various water-filled enclosures is a flexible thin film of an organic polymer such as polyvinylchloride, polyethylene, polypropylene, polyvinylidinechloride, polyester and polyurethane. The thickness of the film should be between 10 and 30 mils, and preferably between 15 and 25 mils. Film thicknesses below 10 mils generally lack adequate strength and resistance to abrasive effects, whereas films thicker than 30 mils diminish the unique cushioning characteristics of the underlying water. A particularly preferred film material is plasticized polyvinyl chloride, commonly referred to as vinyl. The usual plasticizers, such as phthalate esters, may be present in the usual amounts to impart plasticity to the otherwise stiff polymer. The film material may in some embodiments consist of a fabric and film laminated structure, or a fabric rendered impervious by having been coated or calendered with a resinous material.

The bonding of the film to form the requisite three-dimensional envelopes for the chair of this invention may be achieved by known techniques involving either adhesives such as hot melt or solvent-based compositions, thermal welding using dielectric heating electrodes operated at 100 to 300 megaherz in the case of vinyl film, ultrasonic bonding methods, and other systems. In general, all bonds must be continuous and sufficiently strong and impervious to confine water. The fabrication of the envelopes is preferably carried out almost to completion prior to filling of the envelope with water through a narrow opening which is subsequently sealed. The sealing of the narrow opening may in certain instances be achieved by reversible means to permit the emptying and re-filling of the envelopes. It is also contemplated that, for the purpose of minimizing shipping weight, the chairs may be filled with water by the ultimate user, who would complete the sealing of the narrow opening. When filled with water, it is preferable that little residual air be present. However, in some embodiments the presence of small amounts of air may provide modified cushioning effects.

Figure 4:
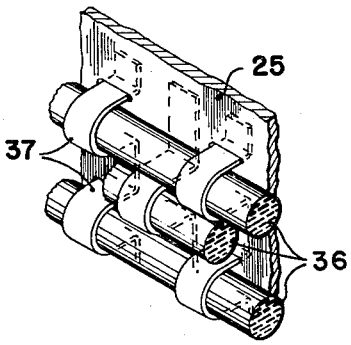
FIG. 4 is a fragmentary transverse sectional view of the upright portion of another embodiment of the chair of the invention.

The elongated horizontally disposed enclosures, when filled with water have an arcuate outer boundary surface convex in the direction of the seating portion of the chair when viewed in a plane perpendicular to the horizontal axes of said enclosures. From 5 to 20 of such elongated enclosures are preferably employed. Although the embodiment of FIGS. 1 and 2 involves integrally connected elongated enclosures, said enclosures may be separate structures, as shown in FIG. 4 wherein the separate cylindrical tubes 36 are held in place by a plurality of parallel straps 37 which alternatively interweave around tubes 36 and through back panel 25. The tubes 36 may have a diameter between 1 and 4 inches. In general, it is preferred that adjacent horizontally disposed elongated enclosures be in contact along their length. However, in embodiments utilizing separate horizontal enclosures, spacing means may be provided in the form of shelves attached to back panel 25, or contoured channels within said panel.

Additional water-filled reservoirs may be recessed within the upper surfaces 15 of the arm rests. Means may be provided for electrically heating and/or vibrating different parts of the chair, the controls for such effects being located convenient to either arm rest. The water utilized to fill the enclosures may contain viscosity-modifying agents such as water-soluble polymers to achieve novel cushioning effects. Algeacides and bacteristats may also be added to the water.

Although the seating portion illustrated in the embodiment of FIGS. 1 and 2 is bounded by panels which extend to the floor, other constructions may be utilized having clearly discernible legs. The general shape of the seating portion may be rectangular, as in the illustrated embodiments, or alternatively round, non-round curvilinear, polyhedral, and combinations thereof. The water filled container positioned in the seat portion may also be of varied shape. Its depth ranges from about 6 to 12 inches.

Embodiments of the chair of this invention are also contemplated wherein the chair functions as an adjustable recliner chair. In such embodiments, front panel 17 will be adapted to swing upwardly, and may be provided with a series of horizontally disposed elongated water-filled enclosures similar to enclosures 26.

The angle A of the upright portion 11 with respect to the seating portion may vary from about 95 to 140 degrees, and may be adjustable. The upright portion may be straight or curved and may have a head or neck rest at its uppermost end protruding beyond the assembly of horizontal enclosures in the direction of the seating portion.

While particular examples of the present invention may have been shown and described, it is apparent that changes and modifications may be made herein without departing from the invention in its broadest aspects. The aim of the appended claims, therefore, is to cover all such changes and modifications as fall within the true spirit and scope of the invention.

Having thus described our invention, what is claimed is:

1. A chair comprising a seating portion having an outer structure adapted to position the chair above a floor and to provide a supportive base for other components, said outer structure confining a water-filled container fabricated at least in part of a flexible film and having substantially identically shaped upper and lower surfaces interconnected by a vertically disposed sidewall of six to twelve inch height, said upper surface being flat and horizontal, said lower surface being supported by a shelf positioned within and attached to said outer structure, said sidewall abutting generally vertical surfaces associated with said outer structure, paired arm rests disposed on opposite vertical sides of said container as part of said outer structure, the uppermost portions of which are disposed at a level above the upper surface of said water-filled container, each of said arm rests having recessed therein a water-filled reservoir, and an upright portion originating at the rear of said seating portion and comprising a rigid substantially flat back panel, a surface of which faces said seating portion and supports an assembly of 5 to 20 water-filled elongated enclosures fabricated of thin flexible film and disposed horizontally as a parallel array, said enclosures having an arcuate shape convex in the direction of said seating portion when viewed in a plane perpendicular to the horizontal axes of said enclosures, and having a hydrostatic pressure between 1" and 4" of water, whereby said chair provides the user a buoyancy effect and supportive characteristics generally analogous to those of a water-filled mattress.

2. The chair of claim 1 wherein said upright portion forms an angle of between 95 to 140 degrees with respect to said seating portion.

3. The chair of claim 1 wherein said upper and lower surfaces of said water-filled container are of rectangular shape.

4. The chair of claim 1 wherein said assembly of water-filled enclosures is an integral structure fabricated by the selective bonding of an upper sheet to a backing sheet.

5. The chair of claim 1 wherein the thickness of flexible film employed for fabrication of said water-filled container and water-filled elongated enclosures is in the range of 15 to 25 mils.

6. The chair of claim 4 wherein said assembly of water-filled enclosures comprises peripheral apron strips as continuous integral extensions of said assembly, and clamping bars applied against said apron strips to cause affixment of said assembly to said back panel.

7. The chair of claim 1 wherein the sidewall of said water-filled container at the front thereof is truncated adjacent the upper region thereof, joining with the upper surface of said container at a location displaced inwardly toward the center of said container.

* * * * *